US005356105A

United States Patent [19]

Andrews

[11] Patent Number: 5,356,105

[45] Date of Patent: Oct. 18, 1994

[54] RELEASABLE MOUNTING BRACKET FOR A PUMP

[76] Inventor: Del Andrews, 424 Calle De Los Molinos, San Clemente, Calif. 92672

[21] Appl. No.: 158,431

[22] Filed: Nov. 29, 1993

[51] Int. Cl.[5] ..... A47B 96/06

[52] U.S. Cl. ..... 248/221.3; 248/674

[58] Field of Search ..... 248/224.2, 223.4, 222.1, 248/225.1, 674, 224.1, 221.3, 220.2; 417/313

[56] References Cited

U.S. PATENT DOCUMENTS

| | | | |
|---|---|---|---|
| 495,537 | 4/1893 | Westerman | 248/224.2 |
| 541,864 | 7/1895 | Loomis | 248/224.2 |
| 4,632,348 | 12/1986 | Keesling | 248/222.1 |
| 4,679,709 | 7/1987 | Poitras | 248/223.4 X |
| 4,948,085 | 8/1990 | Mittelhauser | 248/221.3 X |
| 5,035,389 | 7/1991 | Wang | 248/225.1 X |
| 5,060,898 | 10/1991 | Chang | 248/224.2 X |
| 5,226,625 | 7/1993 | Hanna | 248/224.1 X |

FOREIGN PATENT DOCUMENTS

| | | | |
|---|---|---|---|
| 629040 | 9/1949 | United Kingdom | 248/224.2 |

*Primary Examiner*—J. Franklin Foss
*Attorney, Agent, or Firm*—Francis X. LoJacono

[57] ABSTRACT

A mounting bracket assembly adapted for releasably mounting a bait pump to the transom of boat below the waterline, wherein the mounting bracket assembly comprises a tapered mounting bracket that is fixedly secured to the transom and a pump support carriage which is removably attached to the mounting bracket by means of a flexible latching tongue that is integrally formed as part of the pump support carriage, the bait pump being fixedly secured within a cup-like receptacle so as to be readily removed with the pump support carriage.

10 Claims, 1 Drawing Sheet

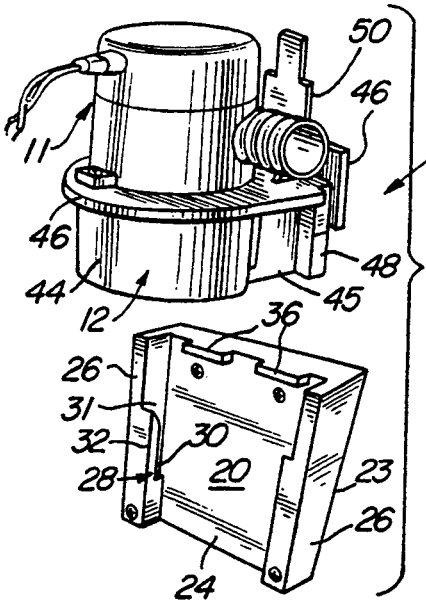
FIG. 1
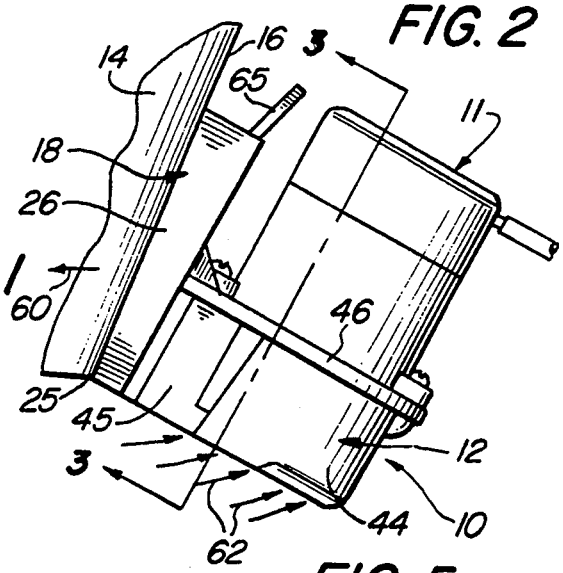
FIG. 2
FIG. 4
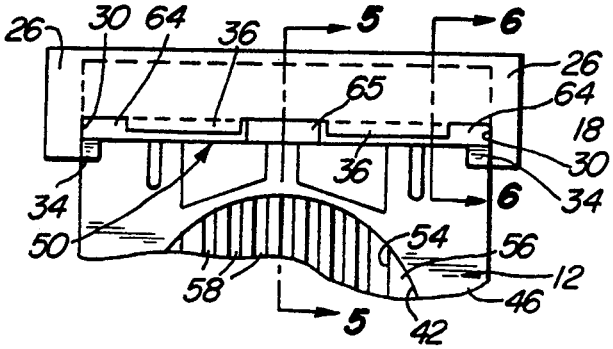
FIG. 5
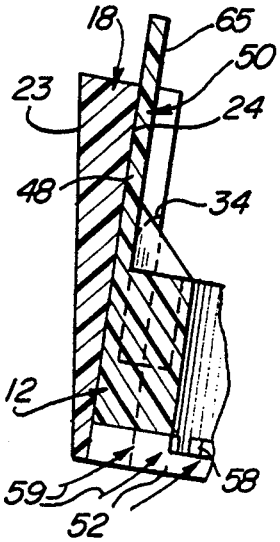
FIG. 3
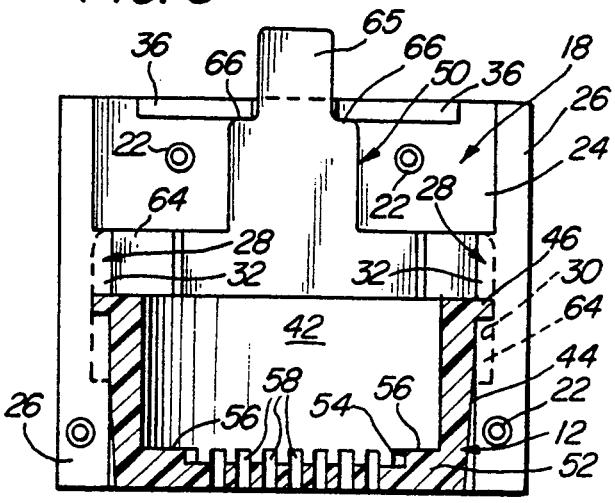
FIG. 6
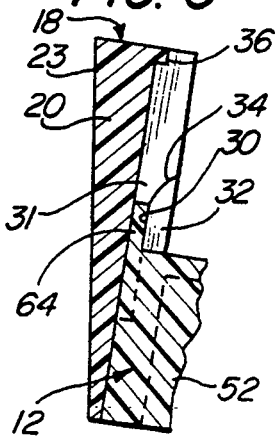

RELEASABLE MOUNTING BRACKET FOR A PUMP

BACKGROUND OF THE INVENTION

1. Field of the Invention

This invention relates to a bracket for mounting pumps and refers more particularly to a mounting bracket adapted to releasably support a suitable centrifugal flow pump of the type associated with boats, wherein the mounting bracket includes a removable pump-support carriage member in which the pump is fixedly secured.

2. Description of the Prior Art

As is well known in the art, various problems and difficulties are encountered in providing suitable means for pumping water directly into a bait tank, particularly of the type that is removably mounted to the transom at the rear of a boat. Pumps that are used for pumping water to a bait tank are generally referred to as bait pumps. These pumps are often fixedly mounted inside the hull to the rear of the boat and are interconnected to an inlet device that is mounted in the bottom wall of the hull so as to draw water from the body of water in which the boat is located. The bait pump outlet is commonly attached to a bait tank by a suitable arrangement.

Another type of pump apparatus comprises a bait pump which is mounted to the bait tank with a hose that extends downwardly along the outer side of the transom so as to be positioned well below the waterline. The terminating end of the hose is provided with a one-way valve and a kelp filter which extends below the hull.

In both of these arrangements the pump must be in constant operation in order for water to readily flow into the bait tank while the boat is moving as well as at rest. A continuous flow of circulated water must flow through the bait tank in order to keep the live fish being used as bait from dying.

However, these water flow arrangements as well as other well known water flow systems do not allow fresh water to flow through the pump system without the pump being continuously turned on. That is, such systems as described will only allow the water to flow while the pump is in operation.

Until the present time there has been no simple apparatus that provides for a bait pump to be mounted adjacent the bottom edge of the outer side of a transom so that the pump is submerged below the waterline of the boat, and whereby the water is permitted to flow through the system to the bait tank without the need to operate the bait pump while the boat is moving at a suitable speed.

SUMMARY OF THE INVENTION

It is therefore one of the objects of the present invention to provide a relatively simple bait-pump mounting apparatus that allows the bait pump or like pump to be mounted under water on the stern of a boat, flush with the bottom thereof.

Another object of the invention is to provide a pump mounting apparatus that is defined by a pump mounting bracket assembly that includes a bracket member adapted to be fixedly secured adjacent the transverse bottom edge of the transom, and a pump support carriage that is releasably mounted to the fixed bracket member.

Still another object of the invention is to provide a pump mounting assembly that positions the bait pump under the waterline and is formed having a receptacle in which the pump is secured, and wherein the bottom of the receptacle is provided with a plurality of longitudinal slots which are arranged to direct water into the pump as the boat is moving at a suitable speed whereby the water is forced in and through the pump and from the pump to the bait tank by means of a hose.

A further object of the present invention is to provide a pump-mounting assembly of this character wherein the pump is only operated when the boat is dead in the water and can be turned off as the boat moves at a speed suitable to force the water through the flow system to the bait tank.

A still further object of the present invention is to provide an apparatus of this character wherein the receptacle is defined by support carriage having a mounting plate which includes a releasable latching tongue, whereby the mounting plate is adapted to be slidably received in a releasable locking arrangement within the mounting bracket member.

It still another object of the present invention to provide an apparatus of this character, wherein the mounting bracket member is formed to allow the pump receptacle to be angularly disposed below the bottom edge of the transom, whereby water is readily directed through the receiving slots as the water rushes along the bottom of the hull to force the water through the pump and cause it to freely flow to the bait tank while the boat is underway without the need to operate the pump.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

BRIEF DESCRIPTION OF THE DRAWINGS

With the above and related objects in view, the invention consists in the details of construction and combination of parts, as will be more fully understood from the following description, when read in conjunction with the accompanying drawings and numbered parts.

FIG. 1 is an exploded pictorial view of the pump-mounting assembly of the present invention, wherein a typical bait pump is shown mounted in the pump receptacle of the pump support carriage;

FIG. 2 is side-elevational view of the pump-mounting assembly mounted to the transom of the rear of the hull and the pump support carriage being angularly disposed to extend below the bottom edge of the transom;

FIG. 3 is an enlarged cross-sectional view taken substantially along line 3—3 of FIG. 2, wherein the bait pump is not shown mounted therein;

FIG. 4 is a partial top plan view of the pump-mounting assembly;

FIG. 5 is a cross-sectional view taken substantially along line 5—5 of FIG. 4; and FIG. 6 is a cross-sectional view taken substantially along line 6—6 of FIG. 4.

DESCRIPTION OF THE PREFERRED EMBODIMENT

Referring now to FIG. 1, there is shown an exploded view of pump-mounting assembly, generally indicated at 10, wherein a pump means 11 is mounted in a support carriage, designated at 12. The pump means represents any suitable bait pump that may used to pump a continuous flow of fresh water to a bait tank (not shown) in which live fish bait is stored. There are various types of bait tanks. However, the present invention is shown connected for use with the type of bait tank that is removably mounted at the rear of a boat hull 14 and hangs over the transom indicated at 16 in FIG. 2.

Below the support carriage 10, in FIG. 1, there is shown a mounting bracket 18 which is adapted to be fixedly attached to the transom as indicated in FIG. 2. Mounting bracket 18 is formed with a supporting wall 20 in which a plurality of mounting holes 22 are provided and adapted to receive suitable screws for attaching to transom 16. Wall 20 is formed so that its rear facing surface 23 is at an incline relative to the front facing surface 24. This arrangement allows the support carriage 10 to be angularly disposed in a downward direction so as to extend below the transom, as shown in FIG. 2. Mounting bracket 18 is preferably mounted adjacent the lower transverse edge 25 of transom 16, as seen in FIG. 2, and as close to the center of the transom as possible without being subjected to any possible negative water turbulence.

Extending outwardly from the rear supporting wall 20 are two oppositely disposed side walls 26 which are formed with keeper means, generally indicated at 28. The keeper means includes a vertical slot 30 which is formed within the inner surface of each side wall 26. Slot 30 is formed by a longitudinal guide arm 32 and wall 20. The upper end of slot 30 is formed with a mouth-like opening 31, whereas the upper end of each guide arm 32 is formed with a beveled lip 34 to slidably receive pump support carriage 12.

Projecting outwardly from the upper edge of mounting bracket 18 are a pair of protrusions which are shown as transverse spaced-apart rib members 36 positioned to receive therebetween a releasable latching tongue 40 formed on support carriage 12. It should be noted that protrusions 36 can take any suitable form such as rounded nipples or the like.

Referring now to FIGS. 4, 5 and 6, more specific details are illustrated with regards to the pump support carriage 12, which comprises a cup member 42 in which the bait pump is removably mounted as seen in FIGS. 1 and 2. Cup member 42 is defined by an outer semicircular wall 44 that is formed with a semiannular flange 46 integrally formed with side walls 45 that extend rearwardly to be integrally formed with rear wall 48 that defines a latching means, generally designated at 50. Cup member 42 is further provided with a bottom wall 52 which includes means to allow water to flow into the cup and through the bait pump. Bottom wall 52 is formed with a recess 54, whereby a shoulder 56 is defined to provide a means on which pump 11 rests.

The means to allow water to flow into the cup comprises a plurality of longitudinal slotted openings 58 which allow water to flow into cup 42. That is, water can be sucked up by means of pump 11 through the slotted openings when the pump is in an operating mode (as indicated by arrows 59 in FIG. 5) or when the boat is underway at a suitable speed in the direction of arrow 60 which directs the impinging water so that it enters the cup (as indicated by arrows 62) and passes through an inlet (not shown) in the bottom of pump 11 when in an nonoperating mode. The elongated openings are the preferred form but other types of openings can be used in place thereof.

Referring more particularly now to latching means 50, there is shown in the drawings a latching means 50 formed in the upper part of the rear wall 48 of cup 42. Rear wall 48 further includes means for removably attaching the pump support carriage to mounting bracket 18. The removable attaching means comprises a pair of oppositely disposed key members 64 which are positioned to be received in the corresponding vertical slots 30 that are provided in the side walls 26.

A latching tongue 65 is formed so as to extend upwardly from rear wall 48 and is made of a flexible material, such as a suitable plastic, that allows the two key members 64 to enter the respective opening 31 as the support carriage 12 is connected to the mounting bracket 18. Latching tongue 65 includes a pair of oppositely positioned shoulder members 66. These shoulder members engage the two corresponding projecting rib members 36, causing the latching tongue to bend outwardly until shoulders 66 clear the rib members 36, at which time latching tongue 65 snaps back and sits between the pair of ribs members positioning shoulders 66 in engagement with the underside of the rib members, as illustrated in FIG. 3.

Accordingly, to remove carriage 12 tongue 65 is bent outwardly, thereby disengaging the shoulders 66 of rib members 36, allowing the carriage along with the bait pump to be readily removed from the fixed mounting bracket 18.

The foregoing is a description of a preferred embodiment of the invention which is given here by way of example only. The invention is not to be taken as limited to any of the specific features as described, but comprehends all such variations thereof as come within the scope of the appended claims.

What I claim is:

1. A mounting bracket assembly for pumps comprising:

a mounting bracket having a supporting wall and oppositely disposed side walls, wherein keeper means are formed therein;

a pump support carriage defining a support cup, whereby a pump is mountable in said support cup;

a passage means formed in said bottom of said support carriage to allow water to pass therethrough into said support cup and be directed into the pump supported therein;

a rear mounting wall integrally formed with said pump support carriage;

said rear mounting wall being formed with means for attaching said pump support carriage to said keeper means of said mounting bracket and means for releasably latching said support carriage to said mounting bracket as said attaching means is received in said keeper means of said mounting bracket;

said keeper means comprising a vertical slot formed within the inner surface of each of said side walls, wherein each of said slots is formed with an opening therein to receive said attaching means;

wherein said attaching means is defined by a pair of oppositely disposed key members formed along the vertical edges of said rear mounting wall and positioned to be received in said respective vertical slots formed in said side walls of said mounting bracket; and wherein said releasable latching means comprises an upwardly extending latching member formed with a pair of oppositely disposed shoulder members and a latching tongue, said shoulder members being positioned to engage a pair of corresponding projecting members formed on said support wall of said mounting bracket, and wherein said projecting members are spaced apart so as to receive said latching tongue therebetween.

2. A mounting bracket assembly as recited in claim 1, wherein said passage means comprises a plurality of openings formed in said bottom of said support carriage and arranged to direct the incoming water into a recess formed in said support cup, and wherein a peripheral shoulder is defined on which the pump is supported in said cup.

3. A mounting bracket assembly as recited in claim 1, wherein each of said vertical slots of said keeper means is defined by a longitudinal guide arm having a beveled lip, whereby the upper end of said vertical slot is formed with a tapered opening, and wherein said attaching means is slidably received in said slots.

4. A mounting bracket assembly as recited in claim 3, wherein said supporting wall of said bracket is formed with a rear facing surface and front facing surface, wherein said rear and front surfaces are tapered downward and inwardly with respect to each other so that said support carriage is angularly disposed in a downward direction when said mounting bracket is fixedly mounted to a substantially vertical structure.

5. In combination, a mounting bracket assembly with a pump of the type mounted on the transom of a boat below the waterline so as to pump fresh water into a bait tank, the improvement which comprises:

a mounting bracket having a supporting wall and oppositely disposed side walls;

keeper means formed in said side walls;

a pump support carriage defining a support cup, whereby a pump is mountable in said support cup;

a passage means formed in said bottom of said support carriage, whereby water passes therethrough into said support cup and is directed into the pump supported therein;

a rear mounting wall formed with said pump support carriage, said rear mounting wall being formed with attaching means for attaching said pump support carriage to said keeper means of said mounting bracket and latching means for releasably securing said support carriage to said mounting bracket as said attaching means is received in said keeper means of said mounting bracket.

6. The combination as recited in claim 5 wherein said keeper means comprises a vertical slot formed within the inner surface of each of said side walls, wherein each of said slots is formed with an open end to receive said attaching means, wherein each of said open ends is defined by an elongated guide arm having a beveled lip, and wherein said attaching means is slidably received in said slots.

7. The combination as recited in claim 6, wherein said attaching means is defined by a pair of oppositely disposed, outwardly extended key members formed along the vertical edges of said rear mounting wall so as to be received in each respective vertical slot.

8. The combination as recited in claim 7, wherein said latching means comprises an upwardly extended latching member formed with a pair of oppositely disposed shoulder members and a latching tongue, said shoulder members being positioned to engage a pair of corresponding projecting rib members formed on said support wall of said mounting bracket, and wherein said rib members are spaced apart so as to define a recess to receive said latching tongue therebetween.

9. The combination as recited in claim 8, wherein said passage means comprises a plurality of elongated longitudinal openings formed in said bottom of said support carriage, said passage means being arranged to direct the incoming water into a recess formed in said support cup, and wherein a peripheral shoulder is defined on which the pump is supported in said cup.

10. The combination as recited in claim 9, wherein said supporting wall of said bracket is formed with converging rear and front facing surfaces, which are tapered downward and inwardly with respect to each other, whereby said support carriage is angularly disposed in a downward direction when said mounting bracket is fixedly mounted to the transom of a boat.

* * * * *